US006774071B2

(12) United States Patent
Horner, Jr. et al.

(10) Patent No.: US 6,774,071 B2
(45) Date of Patent: Aug. 10, 2004

(54) FOAMED FACER AND INSULATION BOARDS MADE THEREFROM

(75) Inventors: Charles J. Horner, Jr., Piscataway, NJ (US); William K. Longcor, IV, Stillwater, NJ (US); Lorin J. Lichten, Houston, TX (US)

(73) Assignee: Building Materials Investment Corporation, Wilmington, DE (US)

( * ) Notice: Subject to any disclaimer, the term of this patent is extended or adjusted under 35 U.S.C. 154(b) by 155 days.

(21) Appl. No.: 10/117,912

(22) Filed: Apr. 8, 2002

(65) Prior Publication Data

US 2003/0032351 A1 Feb. 13, 2003

Related U.S. Application Data

(63) Continuation-in-part of application No. 09/376,247, filed on Aug. 18, 1999, now Pat. No. 6,368,991.

(60) Provisional application No. 60/099,451, filed on Sep. 8, 1998.

(51) Int. Cl.[7] ..... B32B 5/18; B32B 5/22

(52) U.S. Cl. ..... 442/374; 442/76; 442/77; 442/136; 442/373

(58) Field of Search ..... 442/374, 76, 77, 442/136, 373

(56) References Cited

U.S. PATENT DOCUMENTS

| | | | | | |
|---|---|---|---|---|---|
| 4,572,865 | A | * | 2/1986 | Gluck et al. | 428/309.9 |
| 6,368,991 | B1 | * | 4/2002 | Horner et al. | 442/374 |
| 2001/0032426 | A1 | * | 10/2001 | VanderWerf et al. | 52/284 |
| 2002/0170648 | A1 | * | 11/2002 | Dinkel | 156/44 |

* cited by examiner

*Primary Examiner*—Daniel Zirker
*Assistant Examiner*—Victor S Chang
(74) *Attorney, Agent, or Firm*—Marilyn J. Maue; William J. Davis

(57) ABSTRACT

This invention relates to a low fiber, plyable facer suitable for use in the construction industry, particularly for insulation board manufacture, comprising a dry preformed fiber mat containing a binder for the fibers, preferably a preformed glass mat, coated with a prefoamed composition which contains a polymer latex, a foam sustaining amount of a surfactant and a flame retarding and/or strengthening amount of a mineral filler and also to the use and process for the preparation of the above as well as to a siding underlayment or insulation board having a foamed, thermosetting resin core which is surfaced with said facer as a product for commercial use.

16 Claims, No Drawings

FOAMED FACER AND INSULATION BOARDS MADE THEREFROM

CROSS-REFERENCE TO RELATED PATENT APPLICATION

This application is a continuation-in-part of Ser. No. 09/376,247, filed Aug. 18, 1999 now U.S. Pat. No. 6,368,991 which is a continuation-in-part of Provisional application Ser. No. 60/099,451, filed Sep. 8, 1998. Related U.S. Pat. No. 6,365,533, issued Apr. 2, 2002.

BACKGROUND OF THE INVENTION

Rigid polymeric foam insulation laminates have been used for many years by the construction industry. Uses include commercial roof insulation boards utilized under asphaltic built-up roof (BUR) membranes as well as under various single ply membranes such as EPDM rubber, PVC, modified bitumen membranes and the like. Other uses include residential insulation, as sheathing under siding, and as roof insulation under asphalt shingles and concrete tiles.

Such insulation often takes the form of a core polymeric foamed thermoset material such as polyurethane, polyisocyanurate, polyurethane modified polyisocyanurate (often referred to as polyiso) or phenolic resin, applied between two facing sheets.

These insulation boards are generally manufactured on production lines where a liquid core chemical mixture is poured over a bottom facer, foaming up to contact a top facer in a constrained rise laminator. The reaction of the chemical mixture causing foaming is generally exothermic, as curing via polymerization and crosslinking occurs in the laminator. In the case of polyisocyanurate insulation boards, the curing exotherm lasts well into the time the resulting rigid boards are cut, stacked and warehoused. The exotherm can continue for as long as 4 days and the mixture can reach temperatures as high as 325° F.

Desirable properties for the facers include flexibility, high tensile and tear strength and resistance to thermal degradation. Facer porosity should be low and the thickness of the facer coating should be sufficient to prevent bleed-through of the liquid chemicals prior to foaming. Additionally, facers should exhibit good adhesion to the core foam insulation and be inert to the effects of extraneous chemicals which may be present in the mixture, especially blowing agents that also behave as solvents. Blowing agents currently in use include chlorofluorocarbons like HCFC-141b and R-22 as well as hydrocarbons such as n-pentane, cyclo-pentane and iso-pentane.

One problem that has plagued the polyiso industry has been a phenomenon called "cold temperature delamination". This phenomenon occurs in cold temperature areas where insulation boards coming off the production line cool before they can be "stack cured". In a worst case scenario, the polyiso core foam layer closest to the facer cools, quenching the cure reaction and leaving a brittle layer. This often leads to shearing of the core layer or facer peal off. It has been the practice of manufacturers to place a layer of corrugated cardboard over both the top facer surface of the top board and under the bottom facer surface of the bottom board in the stack, to retain exothermic heat and prevent subsequent delamination. Thus, a facer that inherently insulates and retains heat during stack cure would materially reduce incidents of cold temperature delamination and would eliminate the need for costly cardboard insulation.

After these foamed polymer insulation boards are cured, cut and shipped to their use site, the facer should provide mechanical stability as well as water and weather resistance since, upon installation, they may be exposed to persistent rain, high humidity, ultraviolet light and excessive heat. Additionally, the facers must be puncture and scuff resistant to survive being fastened, e.g., by screws or nails, and walked on. Withstanding temperatures up to 500° F., as encountered in hot asphalt applications, as well as resistance to the deleterious effects of adhesive solvents used in single ply and cold applied roofing membrane applications while strongly bonding to the adhesives themselves are also important facer properties.

Traditionally, facer materials have included asphalt saturated cellulosic felts, fiberglass mats, asphalt emulsion coated fiberglass mats, aluminum foil/Kraft/foil, glass fiber modified cellulosic felts, glass mats onto which polymeric films have been extruded, and glass mats coated with polymeric latex/inorganic binder coatings. However, all of these materials have at least one undesirable property. For example, asphalt-containing products are not compatible with PVC single ply roofing membranes. Fiberglass mats are subject to excessive bleed-through of foamable core chemicals. Aluminum facers and foils reflect heat into the foam during processing which leads to disruption of cell structure, delamination and warping. Further, foil faced sheathing and extrusion or lamination of a polymer film to glass mat surfaces are costly. Specifically, glass mats coated with polymer latex/inorganic binder mixtures have been found to be brittle; conversely, glass fiber modified cellulosic felts are susceptible to moisture absorption aggravating board warping in damp or wet environments.

Other facers which have been employed for siding underlayment and insulation board facers include those disclosed in U.S. Pat. Nos. 5,776,841 and 5,717,012, which are primarily felts.

U.S. Pat. No. 5,001,005 describes a facing sheet composed of glass fibers and a non-asphaltic binder. The facer contains 60–90% glass fibers, which high fiber content does not provide sufficient binder to close the sheet's pores or to provide desired sheet strength. U.S. Pat. No. 5,102,728, describing a glass mat substrate coated with a polymeric latex blended with an asphalt emulsion, concerns a product which is not only incompatible with PVC roofing membranes but also requires excessive coating thicknesses to reduce high porosity. Accordingly, this product is very costly. U.S. Pat. No. 5,112,678 discloses a facer prepared by applying to a fiberglass mat a flowable polymer latex and an inorganic binder coating. The resulting product is somewhat brittle and is susceptible to an undesirable degree of chemical bleed through. U.S. Pat. Nos. 5,698,302 and 5,698,304 describe facers where polymer films are laminated or extruded onto fiberglass mat. Not only is this approach costly, but also since conventional mineral flame retardant filled polymers do not extrude well, some degree of resistance to flammability must be sacrificed.

Accordingly it is an object of this invention to overcome the above disadvantages and deficiencies and to provide a facer which is economically produced by a commercially feasible process.

It is also an object to provide a mechanically stable facer suitable for insulation board manufacture which resists cold temperature delamination and which has superior tolerance to the effects of weathering.

Another object is to provide a facer which exhibits superior adhesion to polyiso foam of an insulation board core material.

These and other objects and advantages of the invention will become apparent from the following description and disclosure.

SUMMARY OF THE INVENTION

The non-asphaltic, non-cellulosic facer of the present invention comprises a dry, preformed fibrous mat substrate on which is coated a pre-frothed or pre-foamed composition containing a natural or synthetic latex polymer, a surfactant and an inorganic mineral filler. The composition may optionally contain up to about 15 wt. % of extraneous additives, which include flame retardants, dyes, thickeners, porosity reducing agents, thermal and/or UV stabilizers, catalysts, antistatic agents, foam cell stabilizers, water repellants and the like, to provide a foamed facer product having, on a dry weight basis, preferably less than 50% fiber in the mat. The preferred facer product contains 30 to 46 wt. % of fiber in the composition consisting of mat fiber with binder and latex in the coating mixture.

DETAILED DESCRIPTION OF THE INVENTION

Generally, the foamed coating composition applied to the preformed mat contains on a dry weight basis between about 15 and about 80 wt. % of the polymer latex, between 0.01 and about 80 wt. % filler, between about 0.5 and about 10 wt. % foam supporting surfactant, 0–5%, preferably 0.1–4% catalyst and 0 to 15 wt. % extraneous additives.

The fibers of the mat employed in this invention include any of the non-cellulosic types, such as fibers of glass, polyester, polypropylene, polyester/polyethylene/teraphthalate copolymers, hybrid types such as polyethylene/glass fibers and other conventional non-cellulosic fibers. Mats having glass fibers in random orientation are preferred for their resistance to heat generated during the manufacture of insulation boards and flame resistance in the finished product.

The fibrous mats of the invention, generally of between about 10 and about 30 mils thickness, conventionally contain a binder which is incorporated during mat formation to fix the fibers in a self-sustaining solid web and to prevent loss of fibers during subsequent processing and handling. Such binders include phenol-, melamine- and/or urea-formaldehyde resins or mixtures thereof. Most preferred are the mats having glass fibers in the range of from about 3 to about 20 microns, most desirably 10–18 microns, in diameter and a length of from about 0.25 to about 1.75 inch, most desirably a length of 0.75–1.5 inch.

The fillers useful in the present coating mixture include conventional inorganic types such as clays, mica, talc, limestone, kaolin, other stone dusts, gypsum, aluminum silicate (e.g. Ecca Tex 561 or Kaoplate C), flame retardant aluminum trihydrate, ammonium sulfamate, antimony oxide, calcium silicate, calcium sulfate, zinc borates, colemanite, and mixtures thereof.

Surfactants employed in the coating composition are organic types suitable for stabilizing latices, such as for example, ammonium salts of a $C_{10}$ to $C_{22}$ fatty acid, e.g. ammonium stearate (STANFAX 320 and STANFAX 388), and disodium or sodium salts, such as, for example, disodium octadecyl sulfosuccinate (STANFAX 318) and sodium lauryl sulfate (STANFAX 234). One or more surfactants can be employed in the coating composition to promote the formation of foam and to maintain the foam structure of the coating before curing.

The latex component of the coating composition includes latex polymers of natural rubber as well as synthetic latices including copolymers of styrene and butadiene and acrylic based resins. Representative examples of these are polyvinyl chloride, styrene/acrylic or methacrylic esters, ethylene/vinyl chloride and polyurethane, polyisoprene, polyvinylidene chloride, polyvinyl acetate/polyvinyl chloride and synthetic rubbers such as SBS, SBR, neoprene, etc. and any other latex polymer and mixtures of the foregoing.

The mat coating mixture of the invention is obtained from a frothed or foamed 15–80 wt. % aqueous emulsion, dispersion or suspension, which is prefoamed by incorporating air in the aqueous liquid mixture, e.g. by blowing or mixing, with vigorous agitation in the presence or absence of a conventional blowing agent. The resulting frothed or foamed, aerated composition is then coated to a thickness of from about 1 to about 100 mils, preferably 2–10 mils, on the preformed mat surface under ambient conditions using a knife blade, a roller or any other convenient method of application. In one aspect, the foam coated mat is then dried at below its cure temperature to provide a foamed, self-supporting product having a reduced coating thickness of up to 90 mils which adheres to the mat surface. In another aspect, the foamed coated mat is dried and cured simultaneously.

The resulting facer product of this invention is desirably flexible and possesses low permability to liquid chemicals used for insulation cores as well as superior dimensional stability and high tensile strength after curing. This product, comprising the mat having an adhered surface coating of a prefoamed latex/filler/surfactant, can be fed directly to insulation board manufacture, e.g. a constricted rise laminator, wherein the uncoated fiber surface of the mat contacts at least one exposed surface of a foamed or foamable thermosetting non-elastomeric core in the manufacture of an insulation board as described hereinafter.

As indicated above, the foamed coating of the present facer can be formed in the absence or presence of a blowing agent to provide a composition of reduced density, which density can be reduced from above about 2 g/cc to as little as 0.1 g/cc. Advantageously, the consistency of the foam is such that the coating mixture does not penetrate through the mat and ideally simulates the consistency of shaving cream.

Generally the amount of air incorporated into the foamable mixture prior to coating is between about 5% and about 80% by volume for optimal consistency and the resulting foamed mixture has bubble openings sufficiently small so as to inhibit liquid bleed through the mat.

Applying a film or laminating a layer of impervious resin or polymer over the foamed surface to provide a trilayered facer member can provide a totally liquid impervious surface on the facer, in special cases where such is desired. A top seal coat of a non-foamed latex is suitable for this purpose. Alternatively, a thermoplastic such as polyethylene powder or unexpanded polystyrene beads can be used as a filler which melts at the drying/curing temperatures to close substantially all pores of the pervious coating. Expandable excipients and additives such as cellulose can also be used for this purpose; although the use of a seal coat is neither needed nor recommended. Other methods for accomplishing the similar purpose include the use of less air during foaming, the omission or use of less inorganic filler in the coating composition, calendering and/or embossing the foamed or frothed surface by contact with a hot roller or platen. Still another method for producing the totally impervious surface involves forming the foam on the smooth surface of a conventional release material and then contacting the mat with the opposite surface of the foam. A combination of any of the above options can be employed for specialized purposes if desired.

In the present case, the facer of the invention having a foamed cellular coating, contains latent exothermic energy and has a higher potential heat capacity upon entering the laminator; thus lowering the lamination cure time and prolonging the generation of heat by acting as an insulator during curing in the post cure stack. This advantage eliminates the need for heat retaining members at the top and bottom of the stack and significantly reduces the prior problem of the board's susceptibility to cold temperature delamination. Additionally, where the foamed coating on the facer is dried and/or cured, the bonding strength between the uncoated fibers and the core material in the resulting product is enhanced due to reduced penetration of the coating mixture into the mat by reason of its prefoamed state. Where the foam of the facer is completely cured before entering the laminator, the core material is either poured onto the uncoated fibrous surface of the facer or laminated thereto with adhesive or bonding agent.

Any pressure which may be applied during lamination in the insulation board manufacture is less than that required to cause a 50% reduction in the thickness of the foamed facer coating and insufficient to result in damage or crushing of the mat fibers in the finished insulation board product.

The weight of the present facer can vary from about 40 to about 300 g/sq. meter and the foamed facer sheet can have a thickness up to about 100 mils depending on the preference of the consumer. For certain purposes demanding tougher facers, laticies which can be crosslinked can be selected.

The present latex coating composition may additionally contain a minor amount, up to 15%, preferably less than about 3 wt. %, of a conventional thickening agent, for example an acrylic polymer thickener, e.g. (PARAGUM 500 and 511, ACRYSOL ASE 95NP and/or 60NP) and the like. Other inert excipients such as a UV or thermal stabilizer, a conventional coloring agent, texturizing agent, reinforcing or crosslinking agent, (e.g. AEROTEK M3 or CYMEL 303 resin), antistatic agent and/or blowing agent may also be included in the coating mixture; although addition of these additives in a minor amount of less than 2 wt. % are preferred.

The coating composition preferably includes a catalyst to provide a faster cure and/or a harder, less abraidable finish. Suitable catalysts include diammonium phosphate (DAP), para-toluene sulfonic acid (PTSA), ammonium chloride, oxalic acid and the like, or combinations of the above. A preferred catalyst is FREECAT 187. The catalyst can be present in an amount up to 5 wt. % and preferably between 0.01–4 wt. % of the cured foam.

The insulation boards, for which the present facer is particularly suited, comprise conventional thermosetting or thermoplastic foam cores, such as foamed polyurethane or polyurethane modified polyisocyanurate or phenol-formaldehyde cores disposed between a pair of facer members which are laminated to the core surfaces. Other non-elastomeric foamable chemicals, such as polyvinyl chloride, polystyrene, polyethylene, polypropylene, and others conventionally employed as core material can also be employed as the insulation board core of this invention. Rigid foamed cores of this type are described for example in U.S. Pat. No. 4,351,873, incorporated herein by reference.

The present facers are also suitable for sheathing or siding underlayment generally of a thickness up to about 1 inch and composed of a non-elastic core material of a chemical or chemical mixture similar to that of the insulation core. The use of instant facer eliminates the need for expensive foil facings which hold and reflect heat and often cause warping and deterioration of wood overlayment. Also, foil and similar facings are easily punctured which gives rise to moisture attack.

In the insulation manufacture, a roll of the present foamed facer sheet product is passed, with its uncoated fiber surface opposite the core surface, to a laminating zone. The board core foam precursor chemical or mixture of chemicals can be poured onto the non-coated fiber surface of the facer sheet or the core of the insulation board can be prefoamed to a self-sustaining consistency. In one embodiment, a first facer of this invention, with its uncoated surface abutting the core, is placed below the core. The fiber surface of a second facer is positioned and spaced above the core to allow for core expansion, e.g. in a constricted rise laminator, where the assembly undergoes an exothermic reaction and curing is initiated or in a free-rise application. During the curing operation the core material foams and rises to engage the lower uncoated surface of the second facer. It is to be understood that one of the first and second facers can be of the same or of a different composition than that of this invention; although it is preferred that both of these facers be those of the invention described herein. More specifically, one of the facer sheets may be selected from those conventionally employed, such as for example a cellulose or cellulose-glass hybrid felt sheet, perlite, aluminum foil, multilaminated sheets of foil and Kraft, uncoated or coated fiber glass mats; although the second facer sheet of the present invention enhances the advantages described herein. As the core foam is spread on the fibrous surface of the first facer sheet entering the laminator, it undergoes an exothermic reaction which can attain a temperature up to about 200° F. The core foam rises to contact the undersurface of the second facer and hardens thereon; thus providing a rigid insulating foam core interposed or sandwiched between two facer sheets. The resulting product can then be cut into boards of desired size and shape. The heat of the exothermic reaction involving polymerization and/or crosslinking, is autogenerated in both the laminator and in the subsequent stacking of insulation boards to insure complete curing of the core and surface coating of the facer. Curing temperatures during stacking can rise up to about 325° F. over a period of up to 4 days.

As another embodiment involving the above operation, the top and bottom positioning of the facer sheets can be reversed so that the facer of this invention is fed and spaced above a conventional facer in a manner such that its non-coated fibrous surface faces the foamable insulating core chemical being contacted on its under surface with another facer sheet. The later procedure is practiced where one facer is a rigid sheet, as in a perlite or particle board facer as opposed to the flexible facer of this invention which can be fed to the laminator as a continuous roll. In this case the foamable insulating core chemical is surfaced on the rigid facer member and rises to engage the fibrous uncoated surface of the present facer.

The latex of the present facer surface layer which, due to its comparatively thick latex foam, and low fiber to coating latex ratio, more efficiently retains heat between the layers of the roll. Hence, lamination of the core can be completed at a faster rate and stacking accomplished without damage to the laminate. Additionally, it is now found that this retention of heat during curing improves core bonding and significantly reduces subsequent "cold temperature delamination" in the product, which is caused by failure of the top layer of insulation to completely cure due to cooler temperature exposure during stacking after leaving the laminator.

The insulation boards incorporating the present facers are useful in commercial roof insulation, residential or commercial wall sheathing etc. Depending upon the intended use, the present insulation board has a core thickness which may vary widely, for example between about 0.5 and about 4 inches or more.

In the above discussion, it will become apparent that it is also possible to form the insulation core separately, i.e. absent contact with the fibers of a facer, and subsequently bond one or more of the present facers to the core using suitable adhesives. In general, the teachings of U.S. Pat. No. 4,351,873 are applicable to the formation of rigid foam cores and adhesion of facer sheets to at least one surface of such cores. This method is incorporated herein by reference.

Polyurethane or polyisocyanurate are most commonly employed as core materials; although other non-elastomeric, foamable chemicals are also employed. Examples of the later include polyvinyl chloride, polystyrene, phenolic resins and the like.

The facer of this invention finds utility in fiberglass mat reinforced gypsum boards and the use of such boards in, e.g., exterior insulation systems (EI Systems). Such boards comprise a set gypsum-containing core having at least one sheet of the facer of this invention adhered to the set gypsum core by a portion of the set gypsum. The gypsum containing core can be sandwiched between two sheets of the facer of this invention. Such boards can be manufactured by methods known in the art, such as, for example, methods described in U.S. Pat. No. 4,647,496.

The facer of this invention also finds utility on boards comprised of a cement core. Such boards can be used as a bonding substrate for, e.g., the application of tiling. The boards are fastened to walls, floors, countertops, and the like, adhesive is applied to the board and the tiles are pressed into the adhesive. Applicant' facer has a bonding surface superior to other facers in the market. The unique open cell foam structure of the facer allows adhesive to penetrate the sheet, thus increasing mechanical bonding strength, without damaging the facer. In the event that the board comes in contact with water prior to the application of tile, the facer has good water resistance, and will not degrade. If the facer becomes wet, the open cellular structure allows for rapid drying.

The facers and the insulation board products of this invention exhibit significantly higher tensile strength than those containing 60–90 wt. % fibers. The present facers also possess resistance to cracking at low temperatures and exceptionally superior dimensional stability and flame retardance. Because of their superior strength and flexibility, the present facer can find broader application, such as non-foil, non-glare sheathings, as shingle underlayment, separation or barrier sheets and the like.

EXAMPLE 1

A 473 ml metal can with a low shear mixer was employed to combine a 51.5% aqueous solution of a self crosslinkable acrylic latex (Rohm & Haas, E-693), a 23.5% aqueous clay slurry (Ecca Tex 561), a mixture of a melamine crosslinking agent (CYMEL 303), an ammonium stearate foam stabilizer (STANFAX 320), an acrylic polymer thickening agent (Acrysol ASE 95NP) diammonium phosphate catalyst and carbon black pigment in amounts shown in following Table 1. The above ingredients were thoroughly mixed for about 10 minutes and then foamed using a high speed Kitchen Aid mixer to produce a foam having a density of 0.2 g./cc. The Brookfield viscosity of the foamed mixture, using an LVT #4 spindle at 30 rpm, was 1,500 cps.

TABLE 1

| INGREDIENT | % Solids | Parts Wet Basis | Parts Dry Basis |
|---|---|---|---|
| Acrylic latex | 48.5 | 100 | 48.50 |
| Kaolin slurry | 76.5 | 90 | 68.85 |
| CYMEL 303 | 100 | 1.5 | 1.50 |
| STANFAX 320* | 33 | 8.0 | 2.64 |
| Acrysol ASE 95NP | 9.3 | 0.8 | 0.07 |
| Water (1/1 mole) | | | |
| Diammonium phosphate | 25 | 2.8 | 0.70 |
| Carbon black | 33 | 0.45 | 0.15 |

*ammonium stearate

The above foamed latex mixture was coated onto the upper surface of a preformed glass fiber mat containing 27.5 wt. % urea-formaldehyde binder and having 72.5 wt. % of average 11 inch long filaments of 15.9 micron average diameter. Coating was accomplished using a Gardner drawdown gauge set to achieve a coating thickness of 30 mils on the mat. The resulting sample was dried in an oven at 125° C. for 3 minutes and then cured at 150° C. for an additional 3 minutes.

The properties of above facer sample was compared with those of commercial samples A, B and C. and the results were as recorded in Table 2.

EXAMPLE 2

Example 1 was repeated except that self-crosslinkable acrylic (RHOPLEX B-959) was substituted for latex (E-693) and the dried prefoamed mixture on the mat was not cured. The unfoamed mixture of this example had a Brookfield viscosity of 3,600 cps.

The uncured, foam-coated mat of this example was introduced to a laminator wherein the uncoated fiber under surface of the mat was contacted with a foamed polyurethane/isocyanurate core of an insulation board and the simultaneous curing of the mat foam and the core was initiated. After about 1–2 minutes in the laminator, at a temperature of about 1200 to 200° C., the laminated board was cut into 4×8 foot boards and the boards squares stacked in units of 25 members to complete curing over a period of 2.5 days.

EXAMPLE 3

Example 1 was repeated except that an additional 45 g of aluminum trihydrate (ALCOA GRADE C-320) was added to the coating mixture to increase flame retardance of the facer. The Brookfield viscosity of the unfoamed mixture was 2,200 cps and the foam had a density of 0.23 g/cc.

Conventional facers most commonly employed are non-coated, cellulose fiber mats which may or may not be reinforced with a minor amount of glass fibers. In Table 2, Examples A and B represent this type. Example A is reinforced with 18% of 1¼ inch long glass fibers, Example B is reinforced with 13% of less than ⅛ inch long glass fibers.

Another type of facer which has had commercial success comprises a glass mat on which a polyethylene coating has been extruded. A facer of this type is represented as Sample C.

The properties of all of the facers in the above examples are reported in following Table 2.

TABLE 2

| Property | Example 1 | Example 2 | Example 3 | Commercial A | Commercial B | Commercial C |
|---|---|---|---|---|---|---|
| Basis Weight, Lbs/480 Sq. Ft. | 13.1 | 13.1 | 15.27 | 19.6 | 22.0 | 11.2 |
| Caliper, mils (ASTM D-146-90) | 35 | 35 | 35 | 18 | 18 | 13 |
| % Fibers | 41.6 | 41.6 | 35.7 | 90 | 90 | 68.3 |
| Tensile Strength, Lbs/Inch (ASTM D-146-90) | | | | | | |
| MD | 45.8 | 44.6 | 45.4 | 29.8 | 42.8 | 33 |
| CMD | 44.9 | 33.1 | 30.2 | 18.5 | 17.6 | — |
| Elmendorf Tear Strength, g-force (ASTM D-689-79) | | | | | | |
| MD | 390 | 387 | 384 | 238 | 132 | — |
| CMD | 457 | 518 | 433 | 395 | 167 | — |
| Mullen Burst Strength | 60 | — | — | 30 | 27 | — |
| Dimensional Stability, (% Expansion Dry to Wet) | | | | | | |
| MD | 0.02 | 0.02 | 0.02 | 0.13 | 0.30 | — |
| CMD | 0.02 | 0.02 | 0.02 | 0.69 | 1.80 | — |

The above examples are representative and it will be understood that many alterations and substitutions can be made therein without departing from the scope of this invention. Reference defining the invention is had to the appended claims.

What is claimed is:

1. A dry flexible facer comprising a non-asphaltic, non-cellulosic fiber mat surfaced with a cured foam comprising (a) between about 15 and about 80 wt. % of a polymer latex, (b) between about 0.01 and about 80 wt. % of a mineral filler and (c) between about 0.5 and about 10 wt. % of a foam supporting surfactant, and (d) between about 0.01 and about 5 wt. % of a catalyst.

2. The facer of claim 1 wherein said catalyst is selected from the group consisting of diammonium phosphate, para-toluene sulfonic acid, ammonium chloride and oxalic acid.

3. The facer of claim 1 wherein said surfactant is an ammonium salt of a $C_{10}$ to $C_{22}$ fatty acid.

4. The facer of claim 3 wherein said salt is ammonium stearate.

5. The facer of claim 1 wherein the latex is an acrylic based resin.

6. The facer of claim 1 wherein said filler is a fire retardant agent.

7. The facer of claim 6 wherein said filler is aluminum trihydrate.

8. The facer of claim 1 wherein said fiber mat comprises glass fiber.

9. The facer of claim 8 wherein said fiber mat contains between about 30 and about 46 wt. % fiber.

10. An insulation board having a non-elastic core and having on at least one surface thereof bonded to an uncoated surface of the facer of claim 1.

11. The insulation board of claim 10 wherein said facer is a glass mat surfaced with said cured foam.

12. The insulation board of claim 10 having a thickness of between about 0.2 and about 4 inches.

13. The insulation board of claim 10 wherein said cured foam of said facer has a density of between about 0.1 and about 0.4 g./cc.

14. A facer-reinforced gypsum board comprising a set gypsum containing core having adhered thereto at least one facer of claim 1.

15. The facer-reinforced gypsum board of claim 14 wherein said gypsum containing core is sandwiched between two facers of claim 1.

16. A tile substrate comprising a board having a cement core and said core adhered to at least one facer of claim 1.

* * * * *